US009140517B2

(12) United States Patent
Coulston

(10) Patent No.: US 9,140,517 B2
(45) Date of Patent: Sep. 22, 2015

(54) ELASTIC BAND PROJECTILE TOY GUN AND METHOD OF ASSEMBLY

(71) Applicant: Robert M. Coulston, Kansas City, MO (US)

(72) Inventor: Robert M. Coulston, Kansas City, MO (US)

(73) Assignee: BOBCO DESIGNS, LLC, Kansas City, MO (US)

( * ) Notice: Subject to any disclaimer, the term of this patent is extended or adjusted under 35 U.S.C. 154(b) by 127 days.

(21) Appl. No.: 13/925,524

(22) Filed: Jun. 24, 2013

(65) Prior Publication Data

US 2013/0340734 A1 Dec. 26, 2013

Related U.S. Application Data

(60) Provisional application No. 61/663,529, filed on Jun. 22, 2012.

(51) Int. Cl.
*F41B 7/02* (2006.01)
*F41B 7/00* (2006.01)

(52) U.S. Cl.
CPC ..... *F41B 7/025* (2013.01); *F41B 7/003* (2013.01); *Y10T 29/49826* (2015.01)

(58) Field of Classification Search
CPC ..... F41B 7/025
USPC ..... 124/19
See application file for complete search history.

(56) References Cited

U.S. PATENT DOCUMENTS 1,234,163 A 7/1917 Henderson
1,723,554 A 8/1929 Malott
1,724,708 A 8/1929 Harris
1,759,084 A 5/1930 Baum et al.
1,821,381 A 9/1931 Gerken
1,883,826 A 10/1932 Schmidt
1,909,927 A 5/1933 Beauchamp et al.
1,921,017 A 8/1933 Weber
2,008,595 A 7/1935 Reed
2,289,490 A 7/1942 Fisher
2,462,723 A 2/1949 Crnich
2,529,047 A * 11/1950 Paul ..... 124/19
2,550,873 A 5/1951 Siders
2,689,558 A 9/1954 Sealer et al.
2,697,425 A 12/1954 McElveen
2,741,238 A 4/1956 Arnold
2,793,635 A 5/1957 Koeller
2,917,037 A 12/1959 Henderson
3,437,084 A 4/1969 Hyter
3,468,296 A * 9/1969 Duval ..... 124/19

(Continued)

*Primary Examiner* — Gene Kim
*Assistant Examiner* — Jeffrey Vanderveen
(74) *Attorney, Agent, or Firm* — Law Office of Mark Brown, LLC; Mark E. Brown; Christopher M. DeBacker

(57) ABSTRACT

A toy gun comprising a plurality of pre-cut thin layer members along with a plurality of pin members, wherein the toy gun is adapted to store a number of elastic bands and to shoot the stored elastic bands in rapid succession. A barrel top notch is adapted to receive front end of a stretched elastic band that will be fired by the toy gun. The stock comprises a series of recesses each of which is adapted to accommodate the rear end of a stretched elastic band. The fore-end member is movable and includes a series of secondary recesses along its back end, staggered in relation to the stock recesses, wherein any particular secondary recess is slightly below the corresponding stock recess and functions to transfer each elastic band from its stock recesses to an adjacent stock recess in the upward direction, toward the firing recess.

7 Claims, 17 Drawing Sheets

(56) References Cited

U.S. PATENT DOCUMENTS

| | | | | |
|---|---|---|---|---|
| 3,494,345 | A * | 2/1970 | Griffiths | 124/19 |
| 3,812,833 | A | 5/1974 | Skillern | |
| 3,919,996 | A | 11/1975 | McAlister | |
| 4,033,313 | A | 7/1977 | Ryan | |
| 4,165,729 | A | 8/1979 | Niemirow | |
| 4,308,850 | A | 1/1982 | Hunter | |
| 4,379,445 | A | 4/1983 | LoBiondo | |
| 4,676,219 | A | 6/1987 | Miller | |
| 4,800,864 | A | 1/1989 | Small | |
| 4,949,494 | A | 8/1990 | Mims | |
| 5,170,770 | A | 12/1992 | Vosloh | |
| 5,205,266 | A | 4/1993 | Kilby, Jr. | |
| 5,222,472 | A * | 6/1993 | Landingham | 124/19 |
| 5,460,150 | A | 10/1995 | Joppe | |
| 5,595,165 | A | 1/1997 | Conte | |
| 5,692,489 | A | 12/1997 | Swanson et al. | |
| 7,690,371 | B2 | 4/2010 | Slaven | |
| 2008/0029104 | A1 * | 2/2008 | Vanderpool | 128/878 |
| 2009/0314272 | A1 | 12/2009 | Lin | |

* cited by examiner

ELASTIC BAND PROJECTILE TOY GUN AND METHOD OF ASSEMBLY

CROSS-REFERENCE TO RELATED APPLICATION

This application claims priority in U.S. provisional patent application Ser. No. 61/663,529, filed Jun. 22, 2012, which is incorporated herein by reference.

BACKGROUND OF THE INVENTION

1. Field of the Invention

The present invention relates generally to an elasticized band projectile toy gun assembled from a kit of parts, and more specifically to an elasticized band projectile gun having multiple and selectable firing modes, where the gun is assembled from a kit of multiple flat portions joined by multiple pin members, providing a safe and easy-to-assemble toy gun with the capability of firing a plurality of elasticized bands either singularly, jointly, or in rapid succession with each loading operation.

2. Description of the Related Art

Toy guns which fire safe projectiles have existed as long or longer than traditional firearms as we know them. What eventually evolved were toy guns capable of firing rubber bands or similar projectiles which could be used to shoot at small paper targets or to antagonize siblings.

Traditional rubber band guns use a variety of mechanisms to hold a band in a stretched position and for releasing that band, resulting in the band being "fired" from the gun toward a target. The simplest such release mechanism uses a simple clothespin which can clasp down on the band and causes the band to be released upon depressing the pin. This results in a simple, yet limited single-fire pistol.

More complicated rubber band guns include repeater pistols which rely upon a tooth wheel which spins as the trigger is depressed. These pistols allow for a rapid succession of shots, but each shot will only fire the band or bands as they are loaded onto the wheel. There is no way to load up additional bands for firing using the wheel mechanism alone.

Other rubber band guns rely on highly complicated mechanical systems to achieve rapidly fired bands; however, these designs are overly complicated and still cannot fire additional bands to those that have been loaded to each firing "tooth." Traditional rubber band guns have not produced a rubber band gun with multiple firing modes as is presented herein.

Heretofore there has not been available a toy gun with the features and elements of the present invention.

SUMMARY OF THE INVENTION

A toy gun assembly comprising a plurality of pre-cut thin layer members along with a plurality of pin members, wherein the toy gun is adapted to store a number of elastic bands and to shoot the stored elastic bands in rapid succession. In a preferred embodiment, the assembled toy gun resembles a shotgun comprising a hand grip, a stock, a trigger mechanism, a barrel, and a movable fore-end pump member. A barrel top notch is adapted to receive one end of a stretched elastic band that will be fired by the toy gun. The stock extends upwardly above the hand grip and comprises a series of recesses each of which is adapted to accommodate the rear end of a stretched elastic band. The fore-end pump member is movable along the barrel element relative to the body of the gun against the resistance of the stretched fore-end elastic band. The stock includes a series of secondary recesses along the back end, staggered in relation to the stock recesses, wherein any particular secondary recess is slightly below the corresponding stock recess and functions as means to transfer each elastic band from its stock recesses to an adjacent stock recess in the upward direction, toward the firing recess. The trigger recess member comprises an integral firing recess and a trigger engaging region. The trigger elastic band loops around the back of the trigger, thus urging the trigger into forward position. The trigger accordingly pushes the trigger recess member and the firing recess backwards.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

As required, detailed aspects of the present invention are disclosed herein; however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as oriented in the view being referred to. The words "inwardly" and "outwardly" refer to directions toward and away from, respectively, the geometric center of the embodiment being described and designated parts thereof. Forwardly and rearwardly are generally in relation to the fore-end (barrel) and the back end (grip), respectively. Said terminology will include the words specifically mentioned, derivatives thereof and words of similar meaning.

The present invention presents a toy gun assembly 2 comprising a plurality of pre-cut thin layer members along with a plurality of pin members, wherein the toy gun is adapted to store a number of elastic bands 44 and to shoot the stored elastic bands in rapid succession. In a preferred embodiment, the assembled toy gun resembles a shotgun comprising a hand grip, a stock, a trigger mechanism, a barrel, and a movable fore-end pump member. A barrel top notch is adapted to receive one end of a stretched elastic band that will be fired by the toy gun. The stock extends upwardly above the hand grip and comprises a series of recesses each of which is adapted to accommodate the rear end of a stretched elastic band.

The fore-end pump member is movable along the barrel element relative to the body of the gun against the resistance of the stretched fore-end elastic band. The stock 38 includes a series of secondary recesses, or teeth, along the back end, staggered in relation to the stock recesses, wherein any particular secondary recess is slightly below the corresponding stock recess and functions as means to transfer each elastic band from its stock recesses to an adjacent stock recess in the upward direction, toward the firing recess. The trigger recess member comprises an integral firing recess and a trigger engaging region. The trigger elastic band loops around the back of the trigger, thus urging the trigger into forward position. The trigger accordingly pushes the trigger recess member and the firing recess backwards.

II. Elasticized-band Projectile Gun 2

Figure 1:
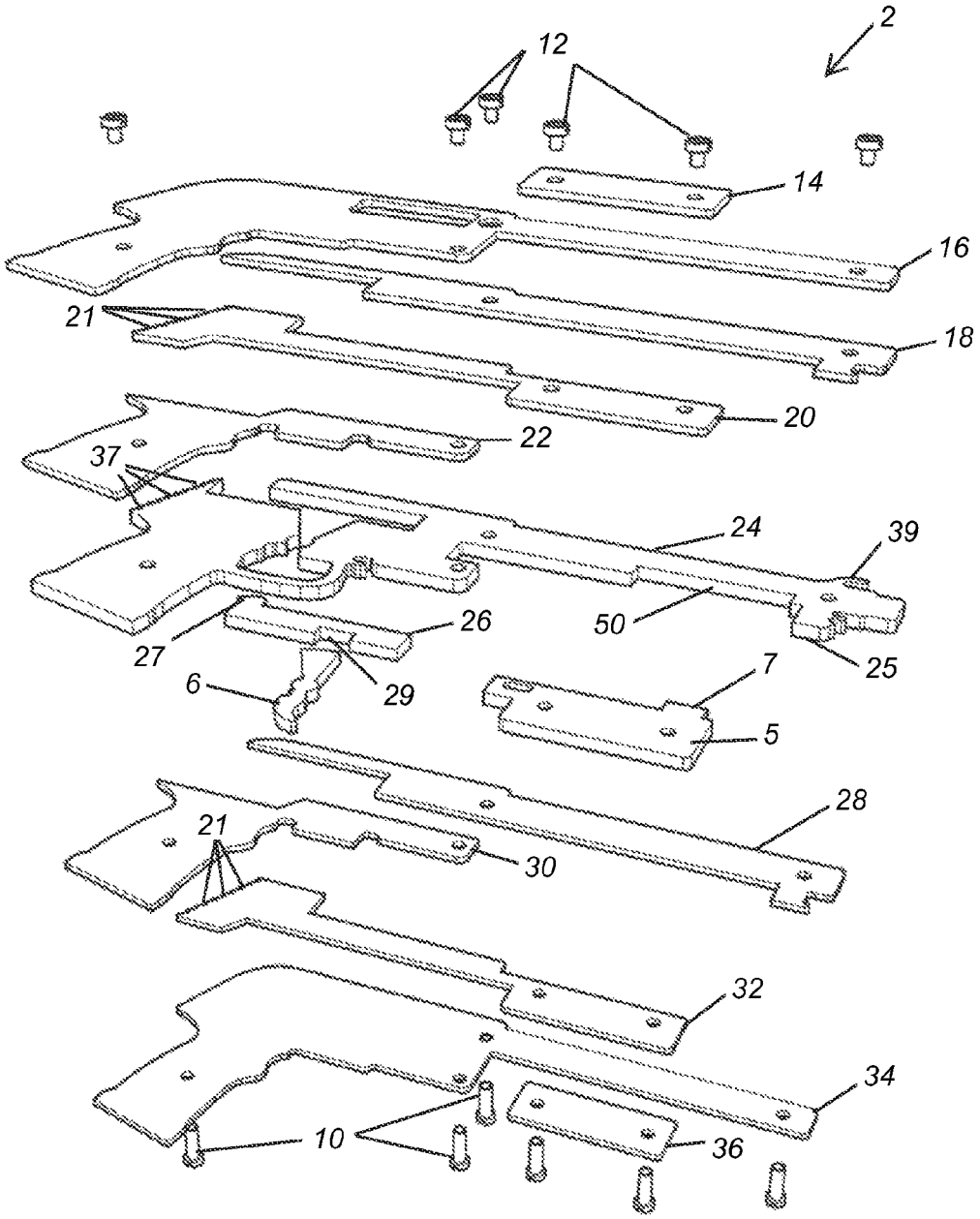
FIG. 1 is an isometric view of a kit of parts of an elasticized-band projectile gun in a disassembled arrangement as an embodiment of the present invention.

Referring to the figures in more detail, FIG. 1 shows a fully disassembled kit for an elasticized-band projectile gun 2. The gun is generally comprised of a number of thin layered pieces 8, joined together by pin members 10, 12. A trigger 6 and a moveable fore-end member 4, which acts similarly to a shotgun pump, are sandwiched in between the layers 8. An assembled projectile gun 2 includes a hand grip portion 46 to allow for an optimally comfortable grip by a human hand, and most likely by a human child. In the shown embodiment, the hand grip surfaces of the outer layer members are progressively smaller compared to the inner-most members, creating a three-dimensional ergonomic grip.

Figure 2A:
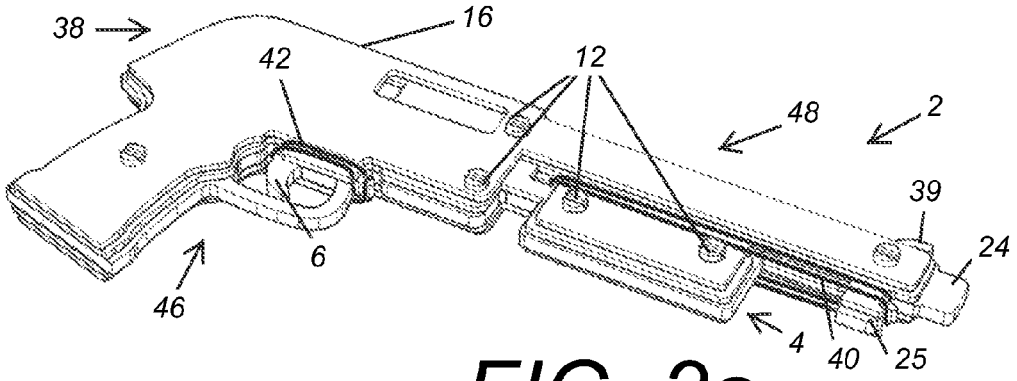
FIG. 2*a* is an isometric view of an assembled elasticized-band projectile gun as an embodiment of the present invention.
Figure 2B:
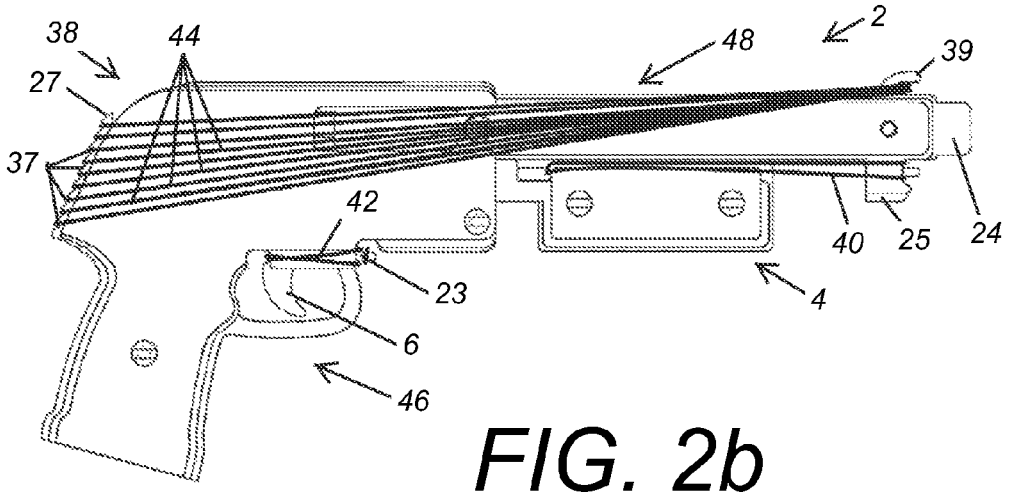
FIG. 2*b* is a side elevation of a loaded elasticized-band projectile gun as an embodiment of the present invention.

FIGS. 2*a* and 2*b* demonstrate a completely assembled projectile gun. The various layers 8 are joined by a first pin portion 10 and a second pin portion 12 in a preferred embodiment, where the pin portions are plastic caps which resemble the heads of screws located on hollow posts that join together. The trigger 6 is mechanically affixed to a trigger notch 23 located on the central-most layer 24 by a trigger elasticized band 42. This connection provides a spring-like effect, wherein upon pulling back the trigger and then releasing the trigger, the band will pull the trigger to its initial position.

Figure 2C:
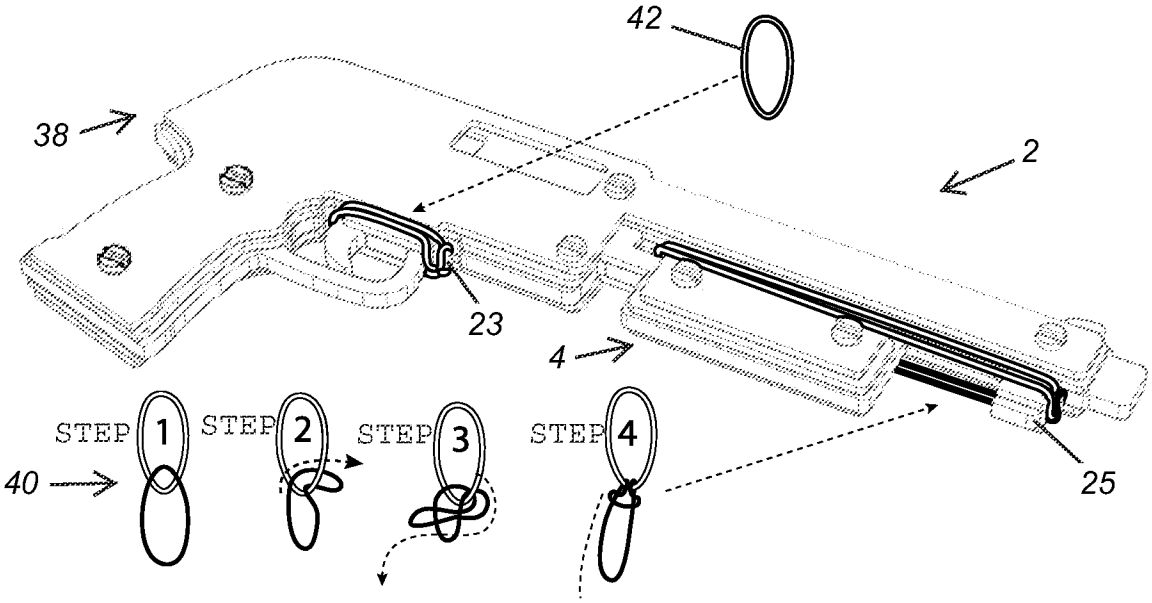
FIG. 2*c* is an isometric view of an embodiment of the present invention showing the steps necessary to arm the projectile gun with elasticized bands.

A similar pair of joined elasticized bands 40 connects the pump 4 to a pump notch 25 also located on the central-most layer. These joined bands are tied together in a unique way as shown in more detail in FIG. 2*c*. Similar to the trigger member 6, the bands 40 allow the pump to be drawn back and reset to an original position upon release.

Figure 3:
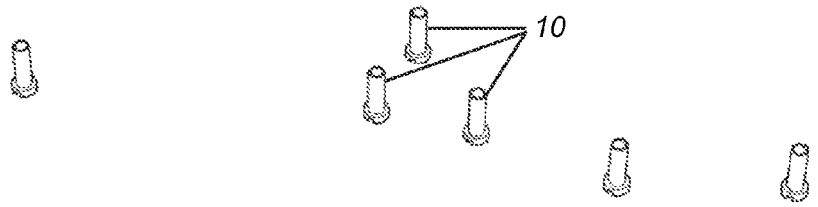
FIG. 3 is an isometric view of a first step of assembling an elasticized-band projectile gun as an embodiment of the present invention.

FIGS. 3-16 demonstrate how the projectile gun 2 is assembled from the various layers and pin members. FIG. 3 shows the first pin members 10 as they would line up with the holes on the various layers 8.

Figure 4:
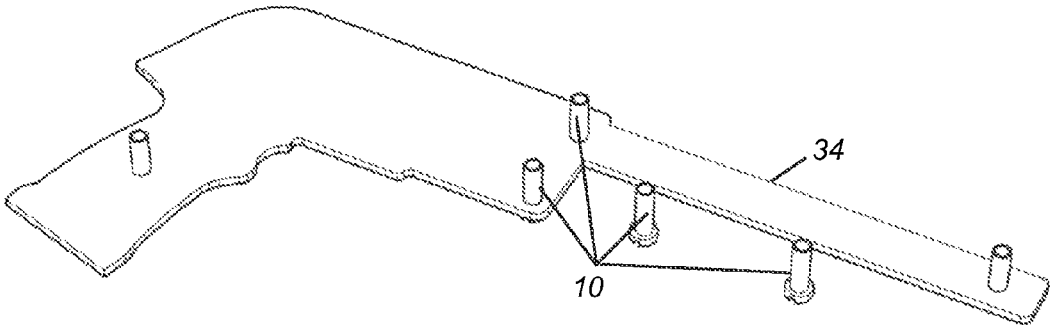
FIG. 4 is an isometric view of a second step thereof.

FIG. 4 shows the bottom most layer 34 with the first pin members 10 inserted through the holes located in that layer.

Figure 5:
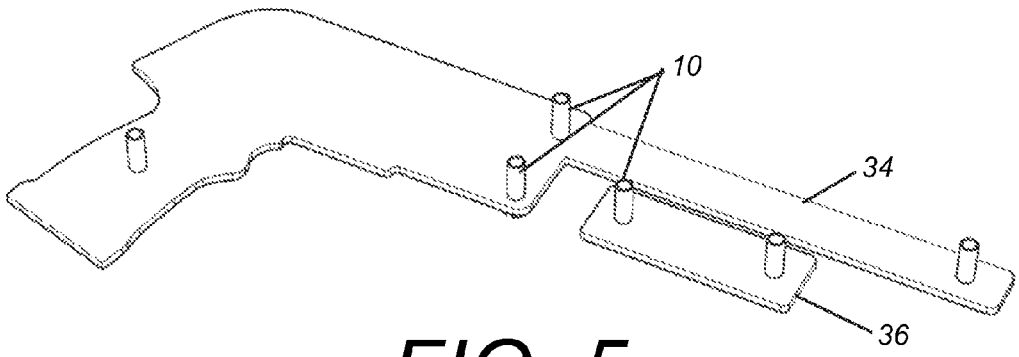
FIG. 5 is an isometric view of a third step thereof.

FIG. 5 adds the outer-most layer 36 of the pump portion 4. The first pin members 10 are inserted through the holes located in that layer.

Figure 6:
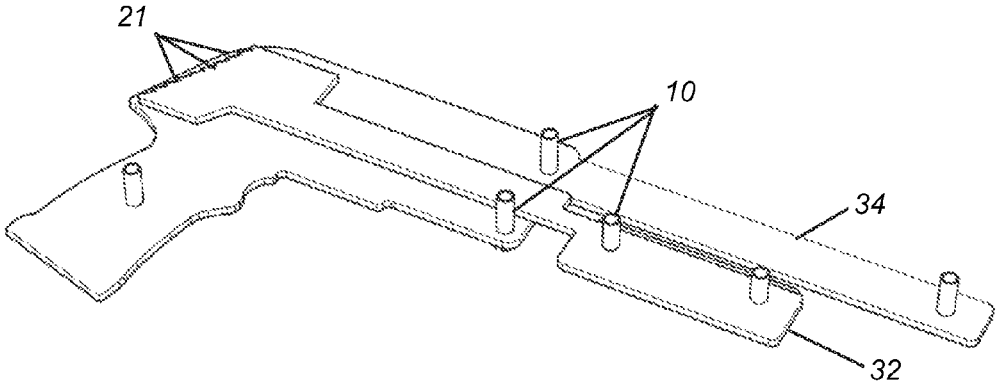
FIG. 6 is an isometric view of a fourth step thereof.

FIG. 6 adds the next layer 32 which includes a plurality of teeth 21 on the rear end of that layer. Again, the respective first pin members 10 are inserted through the holes in the layer 32.

Figure 7:
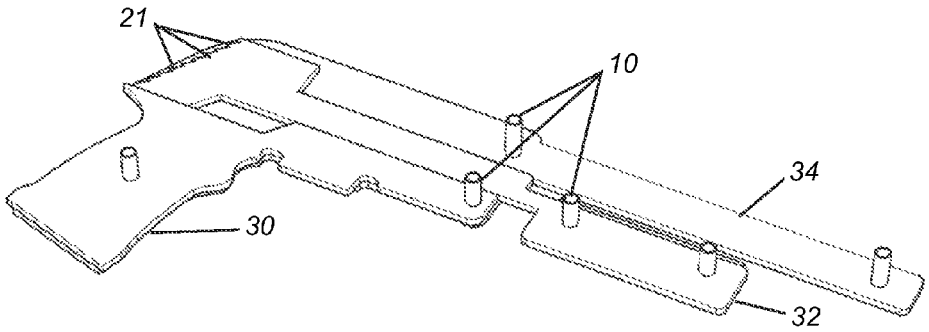
FIG. 7 is an isometric view of a fifth step thereof.
Figure 8:
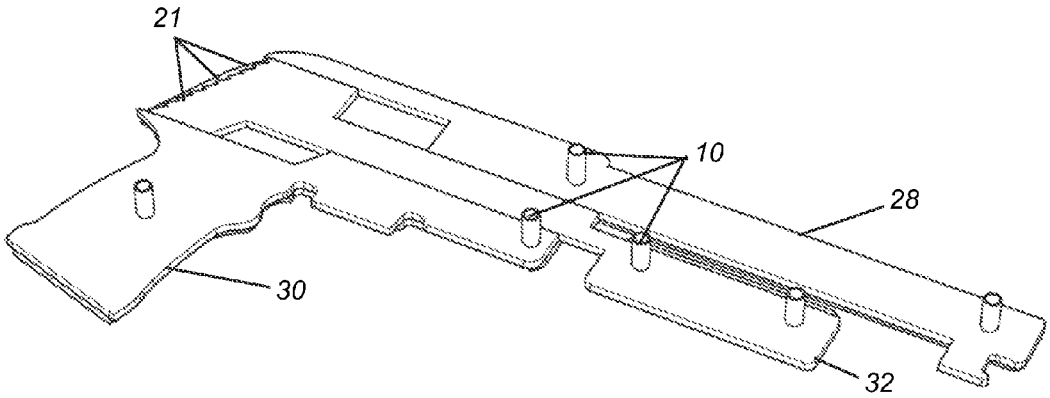
FIG. 8 is an isometric view of a sixth step thereof.

FIGS. 7 and 8 continue this progression, adding the next two portions 28, 30 which are separate elements but exist on the same layer of the gun 2. These elements surround the previous layer 32, such that all three elements exist on the same plane, with element 32 able to slide freely between elements 30 and 28.

Figure 9:
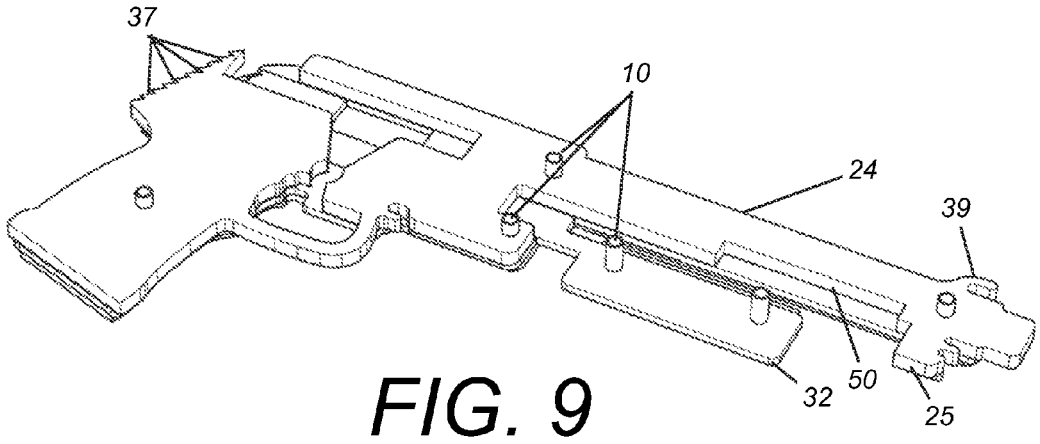
FIG. 9 is an isometric view of a seventh step thereof.

FIG. 9 adds the next layer 24 with the first pin members 10 inserted through the holes located in that layer.

Figure 10:
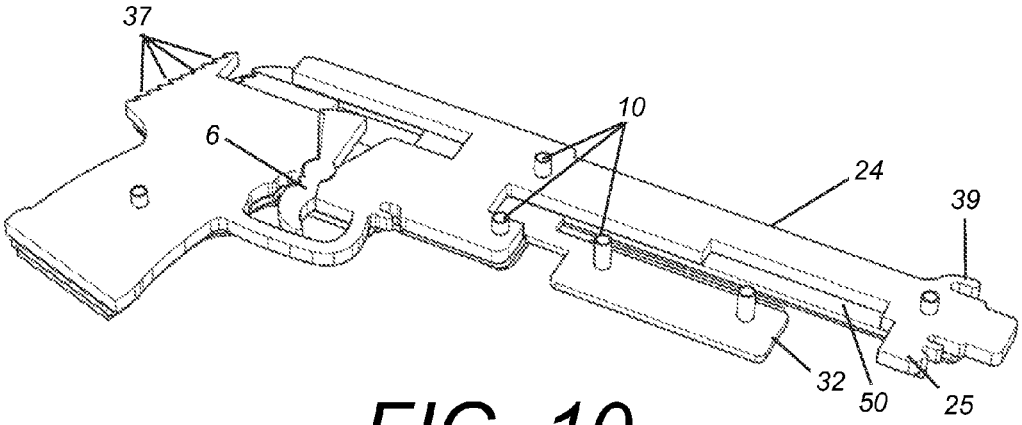
FIG. 10 is an isometric view of a eighth step thereof.

FIG. 10 introduces the trigger 6 slotted into the space located in layer 24.

Figure 11:
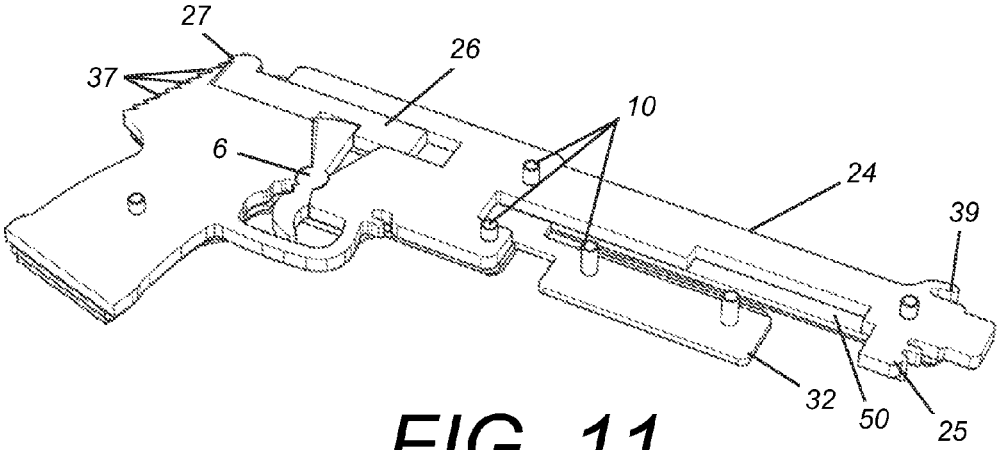
FIG. 11 is an isometric view of a ninth step thereof.

FIG. 11 adds the next firing pin 26 which includes a release tooth 27 and a trigger receiver groove 29. The trigger 6 is received by the groove, and as the trigger is pulled, the firing pin moves forward to release an elasticized band hooked to the release tooth 27.

Figure 12:
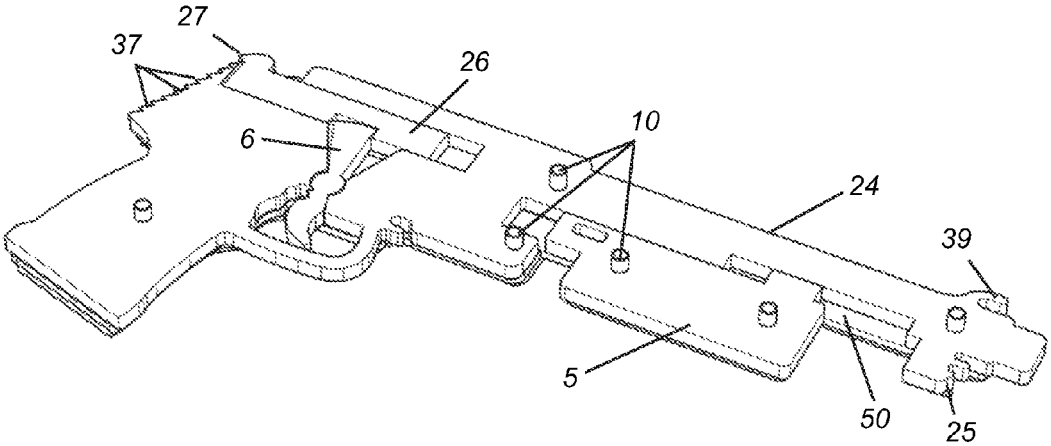
FIG. 12 is an isometric view of a tenth step thereof.

FIG. 12 introduces the main body of the pump 4 and slots the first pins 10 through the holes of that element.

Figure 13:
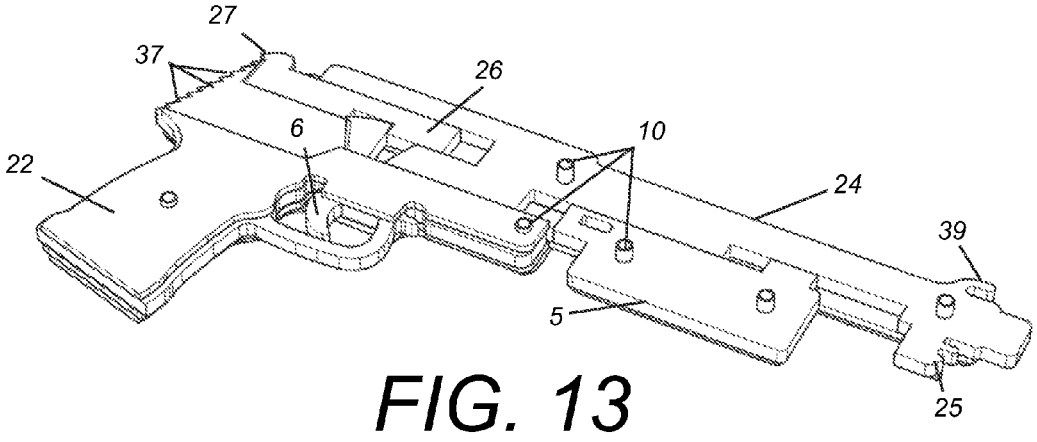
FIG. 13 is an isometric view of a eleventh step thereof.

FIG. 13 adds the next layer element 22 which mirrors layer 30.

Figure 14:
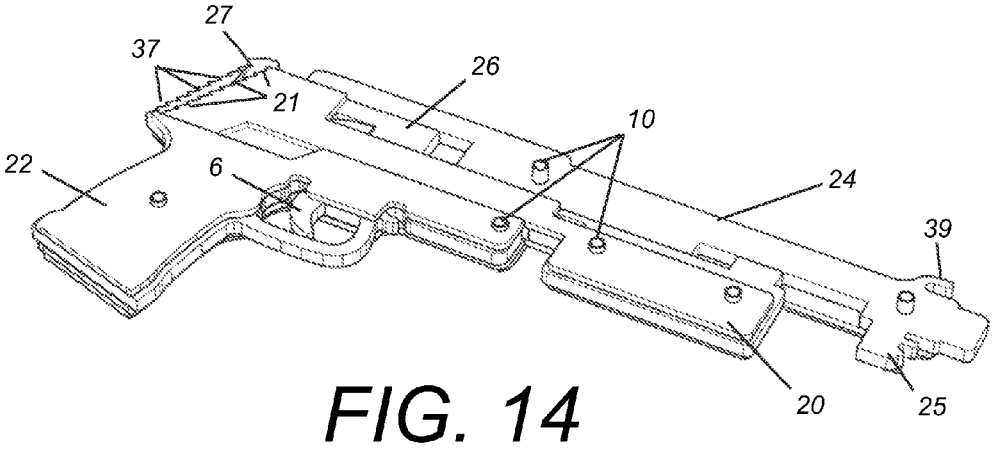
FIG. 14 is an isometric view of a twelfth step thereof.

FIG. 14 adds the next layer element 20 which mirrors element 32.

Figure 15:
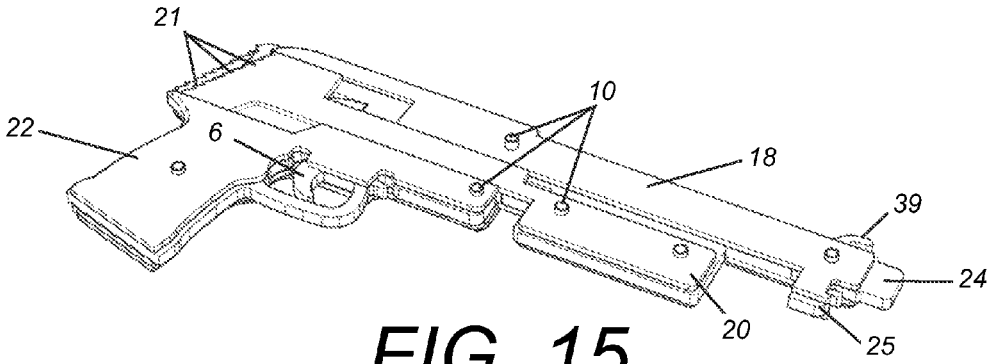
FIG. 15 is an isometric view of a thirteenth step thereof.

FIG. 15 adds the next layer element 18 which mirrors element 28. All three elements 18, 20, and 22 are located on the same plane.

Figure 16:
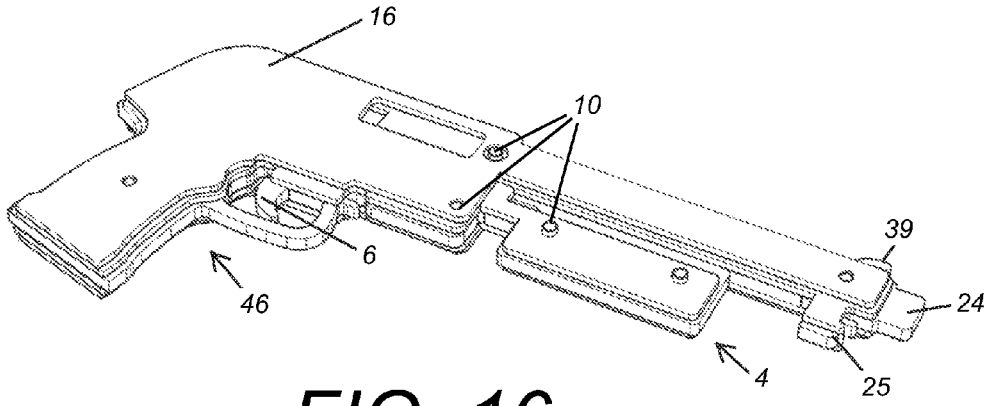
FIG. 16 is an isometric view of a fourteenth step thereof.
Figure 17:
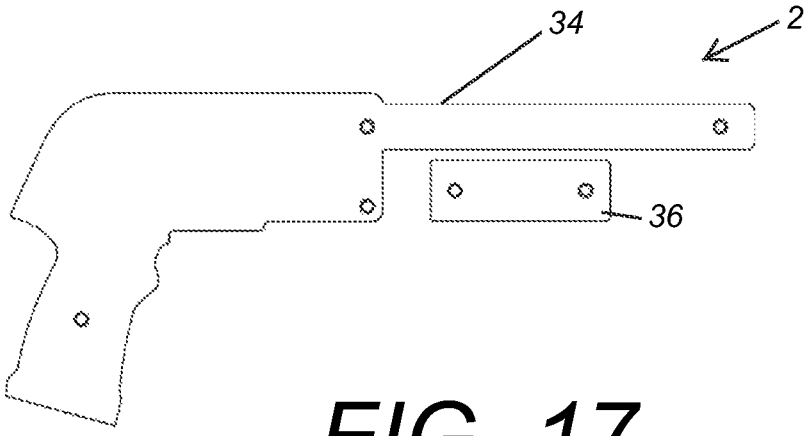
FIG. 17 is a side elevational view of a first step of assembling an elasticized-band projectile gun as an embodiment of the present invention.
Figure 18:
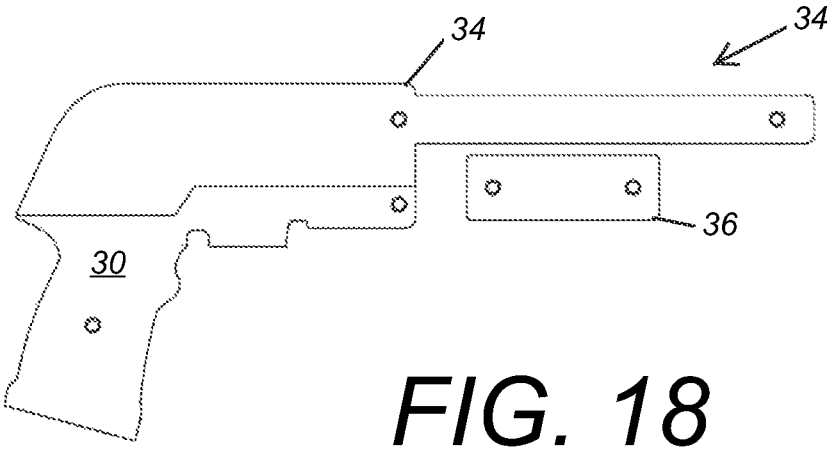
FIG. 18 is a side elevational view of a second step thereof.
Figure 19:
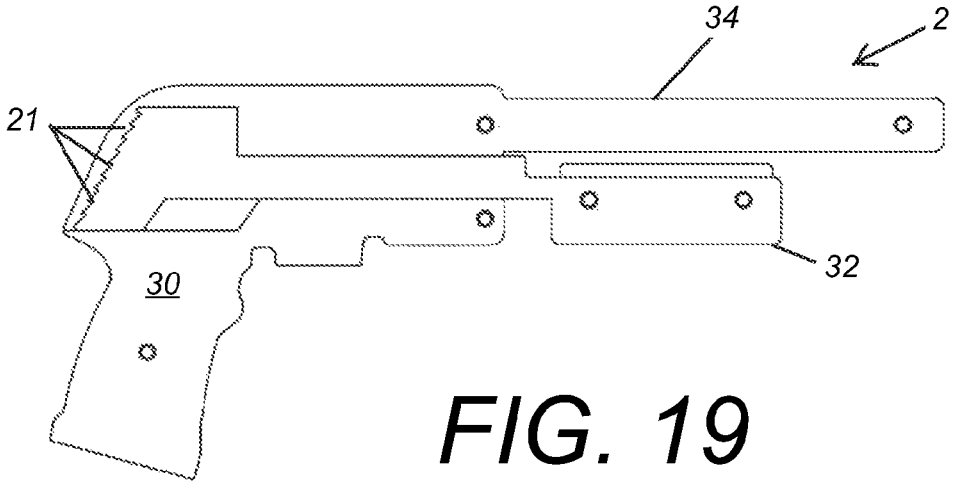
FIG. 19 is a side elevational view of a third step thereof.
Figure 20:
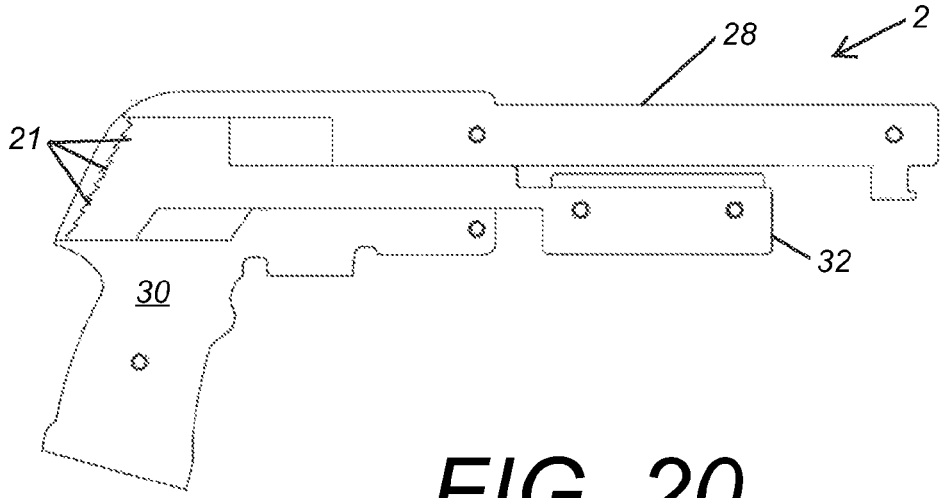
FIG. 20 is a side elevational view of a fourth step thereof.
Figure 21:
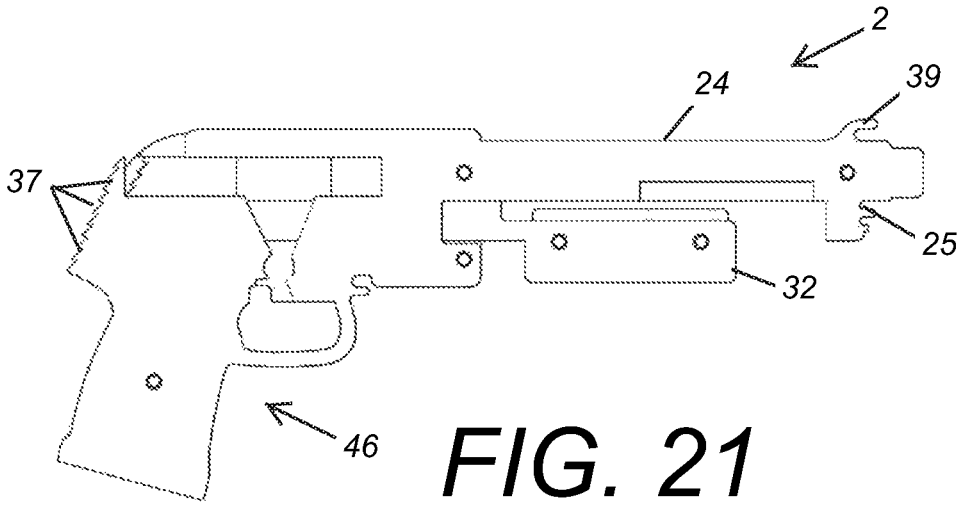
FIG. 21 is a side elevational view of a fifth step thereof.
Figure 22:
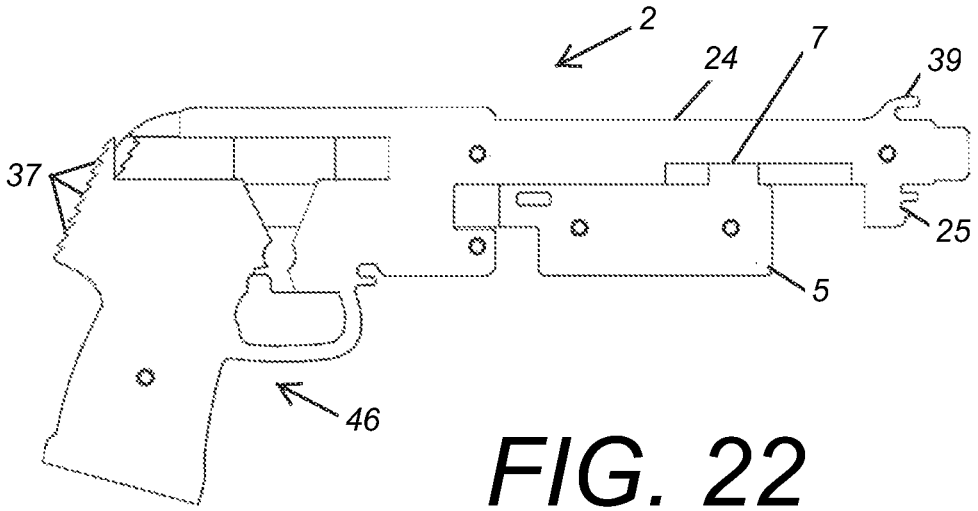
FIG. 22 is a side elevational view of a sixth step thereof.
Figure 23:
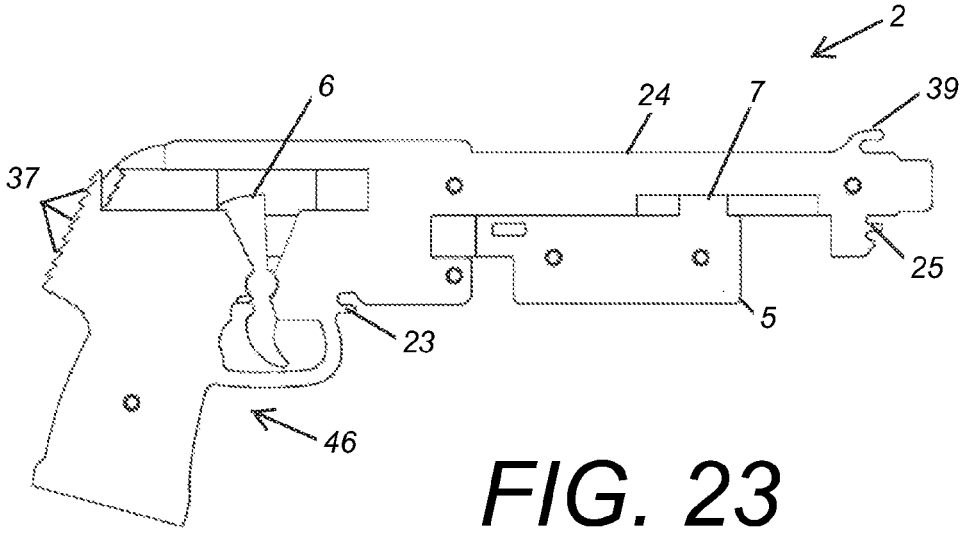
FIG. 23 is a side elevational view of a seventh step thereof.
Figure 24:
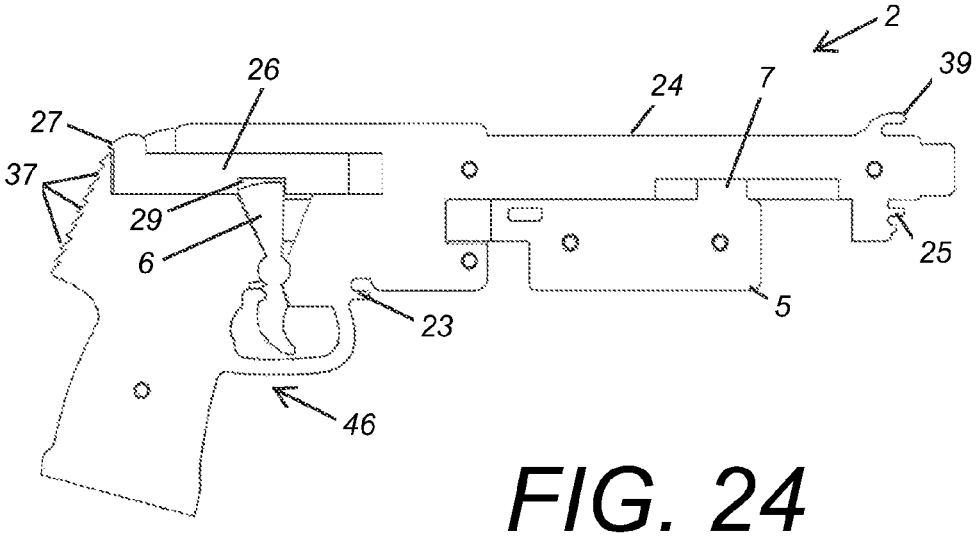
FIG. 24 is a side elevational view of a eighth step thereof.
Figure 25:
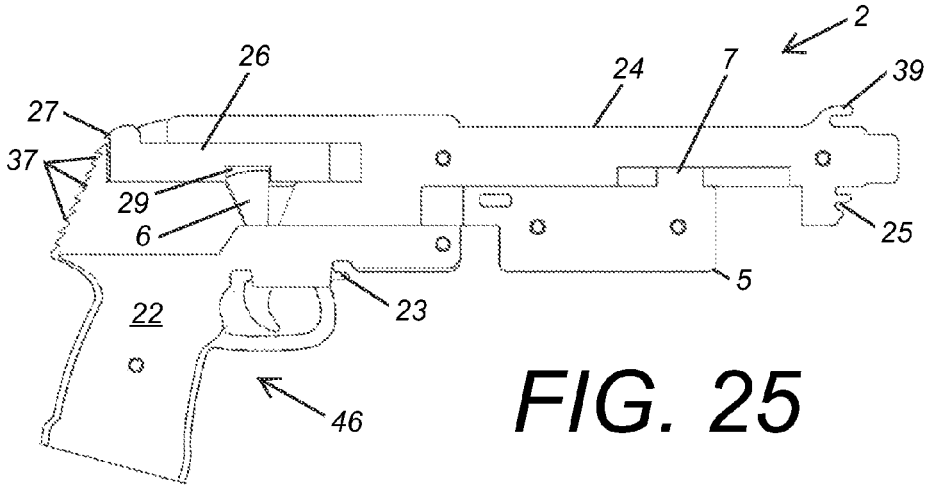
FIG. 25 is a side elevational view of a ninth step thereof.
Figure 26:
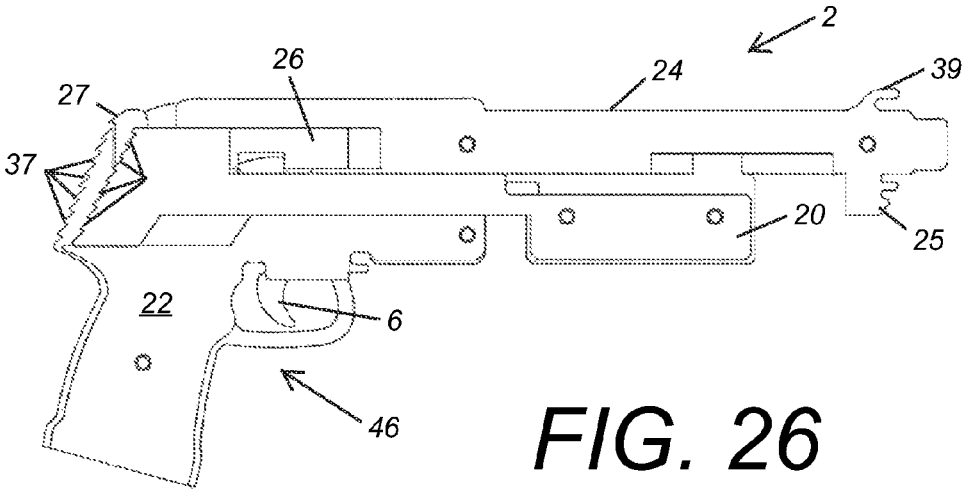
FIG. 26 is a side elevational view of a tenth step thereof.
Figure 27:
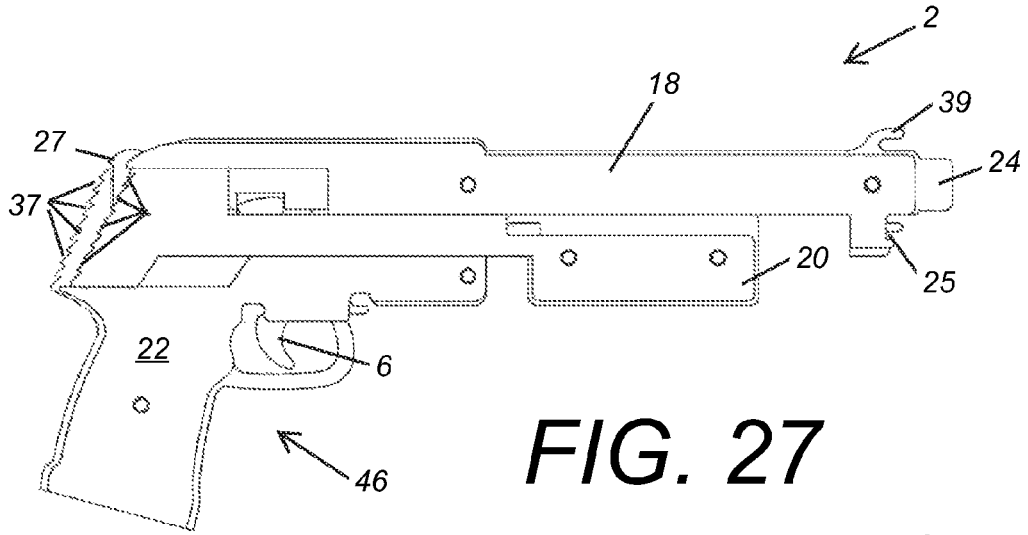
FIG. 27 is a side elevational view of a eleventh step thereof.
Figure 28:
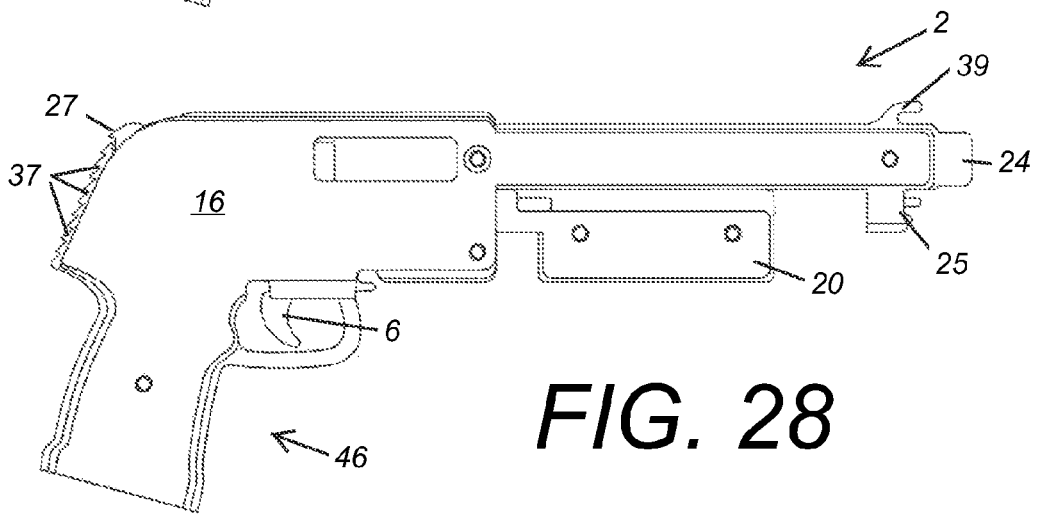
FIG. 28 is a side elevational view of a twelfth step thereof.
Figure 29:
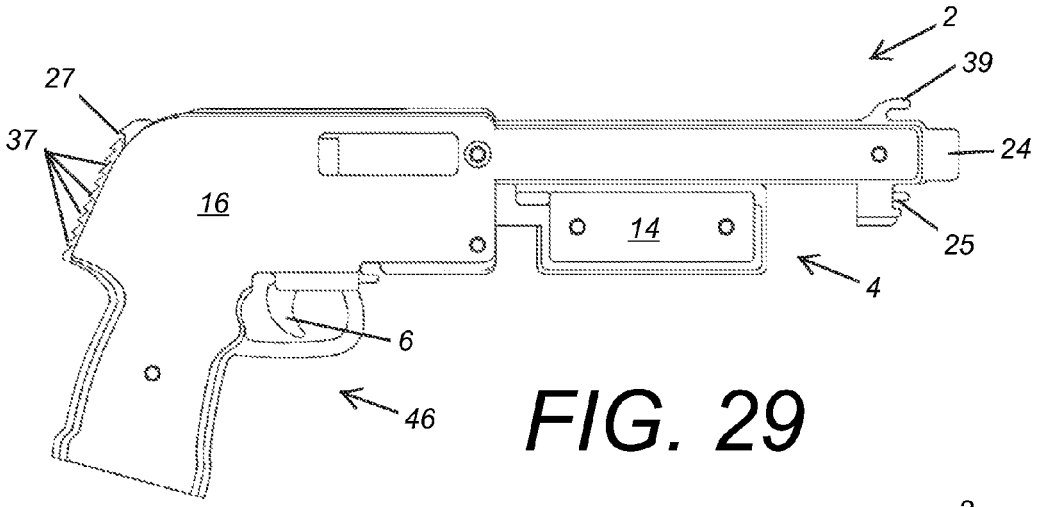
FIG. 29 is a side elevational view of a thirteenth step thereof.
Figure 30:
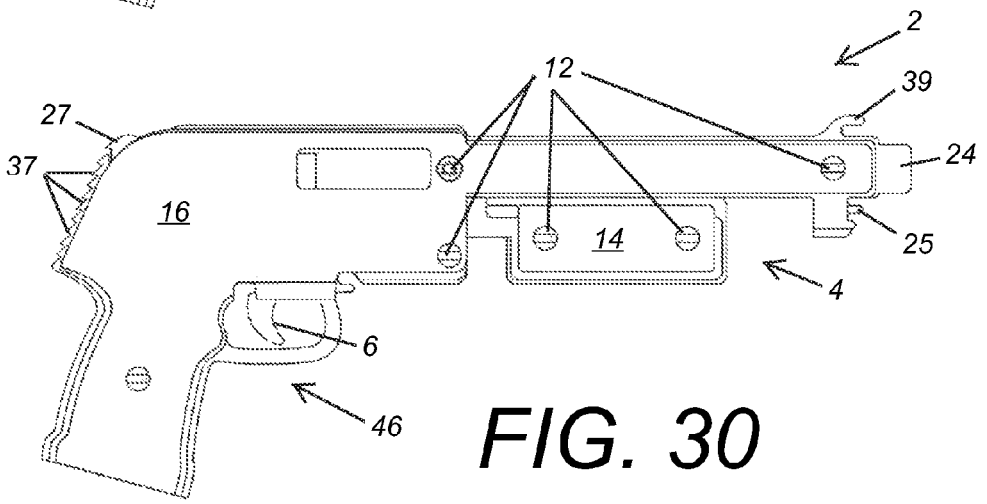
FIG. 30 is a side elevational view of a fourteenth step thereof.

FIG. 16 adds element 16 which mirrors element 34. From here, the second pin portion 12 is inserted into or receives the first pin portion 10 to connect all of the layers 8 together into a single unitary device.

FIGS. 17-30 go through the same steps as above, but from a different view. These figures are meant to increase the ability of one skilled in the art to assemble the present invention from the various elements and pieces presented herein.

The fully assembled projectile gun 2 as shown in FIGS. 2*a* and 2*b* is generally comprised of a forward portion 48 resembling the barrel of a firearm having a top notch 39 and a bottom notch 25, a grip portion 46 resembling the handgrip of a firearm, and a stock portion 38 generally including a number of teeth 37 for receiving elasticized bands for firing. The top notch 39 receives the other end of a stretched elasticized band for firing. The bottom notch 25 receives both ends of a fore-end pair of elastic bands 40 which provide spring-action to the fore-end pump 4 member.

The stock extends upwardly above the hand grip and is adapted to securely receive end portions of stretched elastic bands. The back end of the central layer member comprises a series of recesses each of which is adapted to accommodate the rear end of a stretched elastic band.

The pump 4 is movable along the barrel element relative to the body of the gun 2 against the resistance of the stretched fore-end elastic bands 40. The fore-end pump 4 member comprises a forward layer member 5 and two outer layers 20, 32 securely affixed on each side of the pump 4. Each of the two outer layer members comprises a series of secondary recesses 21 along the back end, staggered in relation to the recesses of the central layer 24. The secondary recesses located on the two movable layer members are symmetrical, wherein any particular secondary recess is slightly below the corresponding central recess and function as means to transfer each elastic band from its central recesses to an adjacent central recess in the upward direction, toward the firing recess.

The forward layer member 5 also includes an upward protrusion 7 adapted to slide along the guiding groove 50 on the bottom side of the barrel as the fore-end pump member 4 moves back and forth. The two ends of the fore-end elastic bands 40 are connected to the barrel bottom notch 25, and the fore-end elastic bands loop around the back of the forward layer member 5 thus urging the pump 4 forward. With the fore-end member in the forward position, the secondary recesses of the two outer layer members 20, 32 are completely retracted within the body of the toy gun.

The trigger mechanism comprises a trigger 6, a trigger recess member 26, a trigger elastic band 42, and a trigger elasticized band notch 27. The trigger recess member comprises an integral firing recess and a trigger engaging region 29 adapted to receive the top end of the trigger. The firing recess 29 is adapted to receive one end of elasticized band 42 that is being fired. The two ends of the trigger elasticized band 42 are connected to the trigger elastic band notch 27, and the trigger elastic band loops around the back of the trigger, thus urging the trigger into forward position. The trigger 6 accordingly pushes the trigger recess member 26, thus positioning the firing recess backwards.

To prepare the gun 2 for firing, additional elasticized bands 44 are stretched between the top barrel notch 39 and each of the central layer member recesses 37 located at the stock end 38 of the gun. An elasticized band may also be stretched between the top barrel notch 39 and the firing recess 29, thus instantly readying the gun for firing.

For semi-automatic firing, a user depresses the trigger 6 which pushes the trigger recess member 26 forward, thus retracting the firing recess 29 within the back of the gun and releasing an elasticized band from the firing recess. To reload the gun 2, the user releases the trigger and then pushes the fore-end pump member 4 backward, causing the two outer layer members 20, 32 to emerge from the back of the stock portion 38 of the gun 2. The secondary recesses 21 transfer each elastic band from its central recess 37 to an adjacent central recess in the upward direction, toward the firing recess 29. Upon releasing the pump, the elasticized band located at the top of central recess 37 is moved into the protruding firing recess 27 as described, which completes reloading the gun for semi-automatic firing.

For rapid-fire firing, a user presses the trigger 6, thus retracting the firing recess 29 within the body of the gun, which in turn releases any elasticized band from the firing recess. While keeping the trigger depressed, the fore-end pump member 4 is repeatedly shifted back and forth, bringing a succession of elasticized bands upward toward the firing recess's 29 initial position. Since the firing recess is retracted within the gun and does not block the topmost elastic band, each band that moves to the topmost position is instantaneously released, resulting in a successive volley of bands released as quickly as the user can activate the pump 4.

For multiple-blast "shotgun" firing, a user repeatedly shifts the fore-end pump member 4 back and forth, thus advancing a number of elasticized bands 44 together on the firing recess 29. This is performed without pressing the trigger 6. When a desired number of elasticized bands are placed onto the firing recess 27, the trigger may be pressed, which causes all elasticized bands located on the firing recess to be released simultaneously, resulting in a shotgun blast of bands.

It is to be understood that the invention can be embodied in various forms, and is not to be limited to the examples discussed above. The range of components and configurations which can be utilized in the practice of the present invention is virtually unlimited.

Having thus described the invention, what is claimed as new and desired to be secured by Letters Patent is:

1. A toy gun kit comprising:

a plurality of layer members aligned along five layers, wherein the third layer is the center layer and the first and the fifth planes layers are outer layers wherein the assembled layer members form a toy gun comprising:

a hand grip;

a stock extending upwardly above the hand grip comprising a series of recesses each of which is adapted to accommodate a rear end of a stretched elasticized band;

a trigger mechanism comprising a trigger, a trigger recess member, and a trigger elastic band, wherein the trigger elastic band loops around the back of the trigger, thus urging the trigger into forward position, and wherein the trigger is adapted to push the trigger recess member and the firing recess backwards thus releasing an elastic band from the firing recess;

a barrel comprising a top notch for receiving firing elastic bands and a bottom notch;

a movable fore-end pump member comprising a series of secondary recesses along its back end, wherein the secondary recesses are staggered in relation to the stock recesses such that any particular secondary recess is slightly below the corresponding stock recess and functions as means to transfer each elastic band from its stock recesses to an adjacent stock recess in the upward direction toward the firing recess;

a plurality of connecting pins comprising a first pin portion and a second pin portion, wherein each said first pin portion passes through two or more layer members and is capped by a respective second pin portion, thereby securing said two or more layer members together;

wherein said toy gun is configured to produce a first, rapid fire mode by depressing said trigger mechanism and rapidly pumping said movable fore-end pump member;

wherein said toy gun is configured to produce a second, multi-shot fire mode by pumping said moveable fore-end pump member two or more times prior to depressing said trigger mechanism; and wherein said toy gun is configured to produce a third, single-shot fire mode by pumping said moveable fore-end pump member only once prior to depressing said trigger mechanism.

2. A toy gun comprising:

a plurality of layered segments joined together by a plurality of fasteners thereby forming a toy gun body;

a trigger member;

one of said plurality of layered segments comprising the center-most layer, said center-most layer including a proximal end and a distal end, wherein said proximal end includes a first plurality of teeth and wherein said distal end includes both a top notch and a bottom notch;

a firing pin member slideably engaged in a firing pin cavity formed in said central-most layer, said firing pin member including a gap adapted for receiving an end of said trigger member, and said firing pin member further including a release tooth;

another layer of said plurality of layered segments comprising a pump-action layer including a second plurality of teeth offset from said first plurality of teeth, said pump-action layer being slideably engaged with said central-most layer;

a pump grip member slideably engaged with said central-most layer;

wherein said toy gun is configured to produce a first, rapid fire mode by depressing said trigger mechanism and rapidly pumping said movable fore-end pump member;

wherein said toy gun is configured to produce a second, multi-shot fire mode by pumping said moveable fore-end pump member two or more times prior to depressing said trigger mechanism; and wherein said toy gun is configured to produce a third, single-shot fire mode by pumping said moveable fore-end pump member only once prior to depressing said trigger mechanism.

3. The toy gun of claim 2, further comprising:

a first elasticized band wrapped around said trigger member and a trigger nub located on said central-most layer; and wherein said first elasticized band establishes a first, unfired trigger position and a second, fired trigger position.

4. The toy gun of claim 3, further comprising:

a second elasticized band stretched from said release tooth to said top notch of said central-most layer, such that said second elasticized band is under tension; and wherein said second elasticized band is released from tension upon said trigger member being depressed, thereby causing said second elasticized band to launch itself toward the distal end of said central-most layer.

5. The toy gun of claim 2, further comprising:

a pair of elasticized bands looped together to form a linked pair of elasticized bands;

wherein a first end of said linked pair of elasticized bands engages said bottom notch located on said central-most layer; and wherein a second end of said linked pair of elasticized bands engages said pump grip member.

6. The toy gun of claim 5, further comprising:

said pump-action layer being rigidly connected to said pump grip member by at least one of said plurality of fasteners; and wherein sliding action of said pump grip member is transferred to said pump action layer, such that moving said pump grip member toward the proximal end of said central-most layer simultaneously moves said second plurality of teeth toward the proximal end of said central-most layer.

7. The toy gun of claim 6, further comprising:

a plurality of elasticized bands stretched from said first plurality of teeth to said top notch of said central-most layer, each of said plurality of elasticized bands having a first end located on a separate one of said first plurality of teeth, and a second end located jointly on said top notch;

wherein as said second plurality of teeth is moved toward the proximal end of said central-most layer, each of said plurality elasticized bands is advanced to the next tooth of said first plurality of teeth; and wherein said release tooth is adapted to prevent the further advancement of any of said plurality of elasticized bands advanced onto said release tooth.

* * * * *